US008050583B2

(12) United States Patent
Yoshikawa

(10) Patent No.: US 8,050,583 B2
(45) Date of Patent: Nov. 1, 2011

(54) FIXING DEVICE HAVING HEATERS CONTROLLED BASED ON TEMPERATURES DETECTED BY FIRST AND SECOND TEMPERATURE DETECTORS

(75) Inventor: Takahiro Yoshikawa, Sagamihara (JP)

(73) Assignee: Ricoh Company, Limited, Tokyo (JP)

( * ) Notice: Subject to any disclaimer, the term of this patent is extended or adjusted under 35 U.S.C. 154(b) by 553 days.

(21) Appl. No.: 12/184,710

(22) Filed: Aug. 1, 2008

(65) Prior Publication Data

US 2009/0052927 A1 Feb. 26, 2009

(30) Foreign Application Priority Data

Aug. 23, 2007 (JP) ..... 2007-216992

(51) Int. Cl.
*G03G 15/00* (2006.01)

(52) U.S. Cl. ..... 399/69

(58) Field of Classification Search ..... 399/69, 399/67, 328, 329

See application file for complete search history.

(56) References Cited

U.S. PATENT DOCUMENTS

| | | | |
|---|---|---|---|
| 5,402,211 | A | 3/1995 | Yoshikawa |
| 5,850,588 | A | 12/1998 | Yoshikawa |
| 6,160,974 | A | 12/2000 | Yoshikawa et al. |
| 6,501,914 | B2 | 12/2002 | Yoshikawa |
| 6,757,502 | B2 | 6/2004 | Yoshikawa |
| 6,823,149 | B2 | 11/2004 | Yoshikawa et al. |
| 7,043,185 | B2 | 5/2006 | Yoshikawa |
| 7,127,204 | B2 | 10/2006 | Satoh et al. |
| 7,174,124 | B2 | 2/2007 | Ishibashi et al. |
| 7,292,801 | B2 | 11/2007 | Yoshikawa |
| 7,313,353 | B2 | 12/2007 | Satoh et al. |
| 7,366,456 | B2 | 4/2008 | Yoshikawa |
| 2006/0013607 | A1 | 1/2006 | Yoshikawa |
| 2006/0204265 | A1 | 9/2006 | Yoshikawa |
| 2007/0059020 | A1 | 3/2007 | Yoshikawa |
| 2007/0274748 | A1 | 11/2007 | Yoshikawa |

(Continued)

FOREIGN PATENT DOCUMENTS

JP 06095541 A * 4/1994

(Continued)

OTHER PUBLICATIONS

Computer Translations: Ueda et al., JP06-95541A, Apr. 1994; Endo, JP2006-308795A, Nov. 2006.*

*Primary Examiner* — Quana M Grainger
(74) *Attorney, Agent, or Firm* — Oblon, Spivak, McClelland, Maier & Neustadt, L.L.P.

(57) ABSTRACT

A fixing device, an image forming apparatus using the fixing device, and a temperature control method therefor. The fixing device includes a fixing roller, a heat roller including first and second heat sources, a fixing belt, a pressure roller including a pressure heat source, a first temperature detector, a second temperature detector, and a pressure temperature detector. The heat sources are regularly on and off according to a duty cycle, and at least one of the heat sources is controlled by the duty cycle during paper feed. A wattage of one of the heat sources is added to a wattage of at least one of the other heat sources when the temperature detected by the first or second temperature detector corresponding to the one of the heat sources reaches the set temperature such that a duty ratio of the at least one of the other heat sources is increased.

10 Claims, 8 Drawing Sheets

U.S. PATENT DOCUMENTS

| | | | |
|---|---|---|---|
| 2008/0031647 | A1 | 2/2008 | Yoshikawa |
| 2008/0101814 | A1 | 5/2008 | Yoshikawa |

FOREIGN PATENT DOCUMENTS

| | | | | |
|---|---|---|---|---|
| JP | 3186906 | | | 5/2001 |
| JP | 2001-265162 | | | 9/2001 |
| JP | 2001-350358 | | | 12/2001 |
| JP | 2004-191549 | | | 7/2004 |
| JP | 2004-264397 | | | 9/2004 |
| JP | 2004354416 | A | * | 12/2004 |
| JP | 2005-257746 | | | 9/2005 |
| JP | 2005-257942 | | | 9/2005 |
| JP | 2006308795 | A | * | 11/2006 |

* cited by examiner

FIXING DEVICE HAVING HEATERS CONTROLLED BASED ON TEMPERATURES DETECTED BY FIRST AND SECOND TEMPERATURE DETECTORS

CROSS-REFERENCE TO RELATED APPLICATIONS

This patent specification is based on and claims priority from Japanese Patent Application No. 2007-216992, filed on Aug. 23, 2007 in the Japan Patent Office, the entire contents of which are hereby incorporated by reference herein.

BACKGROUND

1. Field of the Invention

The present invention relates to a fixing device, an image forming apparatus using the fixing device, and a temperature control method for the fixing device.

2. Description of the Related Art

An electrophotographic image forming apparatus, such as a copier, a printer, or a facsimile, generally uses a heat roller fixing device (including a heat belt fixing device) to fix toner attached to paper onto the paper using heat and pressure. Such a fixing device consumes a large amount of electrical power during operation to heat the paper quickly passing therethrough and compensate for heat loss due to contact with the paper. The power consumption for fixing is increased in a high-speed image forming apparatus as the number of paper passing through the fixing device per unit time increases. At the same time, however, a maximum power consumption specified for the image forming apparatus depends on a power supply situation, and tends not to provide sufficient electrical power under environmental and use-paper constraints particularly like those in effect in Japan or in North America. When the power supply is insufficient, the temperature of the fixing roller included in the fixing device cannot be maintained at a set temperature and declines during paper feed. In order to correct this tendency, the fixing device in the typical high-speed image forming apparatus consumes the maximum allowable amount of electrical power. Also, in a recent mainstream configuration in which a heater of the fixing device is turned off in a standby mode to save energy, the fixing roller needs to be rapidly heated to the set temperature, which also adds to overall electrical power requirements.

An additional problem is that the heater is started using electrical power including the electrical power saved by stopping other operations performed in the image forming apparatus. Consequently, there is a large difference between the heater power consumption while starting the heater and the heater power consumption during paper feed, which again adds to overall electrical power requirements.

Various attempts have been made to conserve power. Thus, for example, one example fixing device reduces heater power consumption to less than the rated power consumption by turning the heater on and off at short but regular intervals.

Another example fixing device activates a plurality of heaters by controlling the duty cycles of the heaters so as to reduce its power consumption for fixing the toner or for achieving a uniform temperature for the fixing roller. In this case, the fixing device is configured to reduce power consumption only when the plurality of heaters is activated.

However, in practical usage, allowable electrical power for the fixing device varies according to the mode of operation, and as such the heaters are unable to respond to such varying statuses simply by controlling their duty cycle. Therefore, such a fixing device is not useful in an image forming apparatus whose productivity is determined by the fixing ability maintained according to the electrical power.

In a typical fixing device including a heat roller having a center heater and an end heater, when a temperature of an end portion of a fixing belt heated by the end heater exceeds a set temperature thereof and a temperature of a center portion of the fixing belt heated by the center heater remains below a set temperature thereof, the end heater may be turned off while the center heater may be fully activated. In this case, however, even with the heater wattage at full activation for the center heater, less than the allowable electrical power for the fixing device is being used. Also, heat transfer through the heat roller from the end portion to the center portion stops by turning off the end heater, and therefore the temperature of the center portion may not be raised to the proper temperature.

By contrast, when the heater wattage for full activation of the center heater is equal to the allowable electrical power for the fixing device, the center heater cannot be efficiently activated in a mode in which the allowable electrical power for the fixing device is deliberately reduced as an energy-saving measure.

SUMMARY OF THE INVENTION

Described herein is a novel fixing device that includes a fixing roller, a heat roller including a first heat source and a second heat source, with the first heat source being a first halogen heater to mainly irradiate a center portion of a paper feed area and the second heat source being a second halogen heater to mainly irradiate an end portion of the paper feed area, a fixing belt stretched around the fixing roller and the heat roller, a pressure roller including a pressure heat source being a third halogen heater and rotating in press contact with the fixing roller, a first temperature detector to detect a temperature of the center portion of the paper feed area on the fixing belt, which is used to control activation of the first heat source based on a set temperature of the center portion, a second temperature detector to detect a temperature of the end portion of the paper feed area on the fixing belt or a temperature of the fixing belt outside the paper feed area, which is used to control activation of the second heat source based on a set temperature of the end portion, and a pressure temperature detector to detect a temperature of the paper feed area on the pressure roller, which is used to control activation of the pressure heat source based on a set temperature thereof. The halogen heaters are configured to be switched on and off at regular intervals according to a duty cycle to reduce power consumption, and at least one of the halogen heaters is controlled by the duty cycle during paper feed. A wattage of one of the halogen heaters is added to a wattage of at least one of the other halogen heaters when the temperature detected by one of the first temperature detector and the second temperature detector corresponding to the one of the halogen heaters reaches the set temperature, such that a duty ratio of the at least one of the other halogen heaters is increased.

Further described herein is a novel image forming apparatus that includes an image bearing member on which a latent image is formed, a charging device to uniformly charge a surface of the image bearing member, an irradiation device to irradiate the charged surface of the image bearing member with light to write the latent image thereon, a development device to visualize the latent image formed on the surface of the image bearing member with toner, a transfer device to transfer the visualized toner image from the surface of the image bearing member to a transfer material directly or via an intermediate transfer member, and the fixing device described above to fix the toner image onto the transfer material.

Yet further described herein is a novel temperature control method for controlling a temperature of the fixing device described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
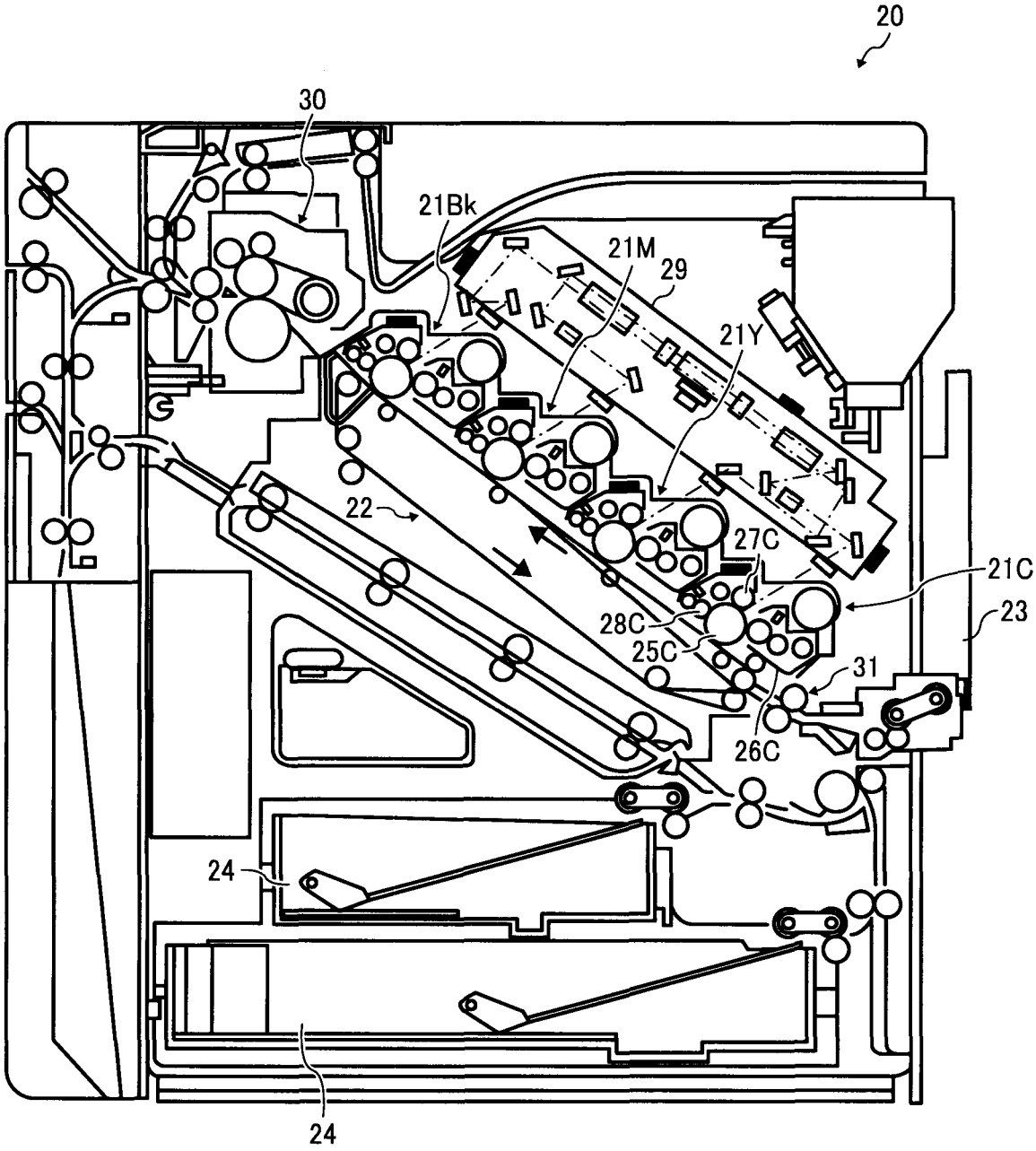
FIG. 1 is a schematic diagram illustrating a configuration of an image forming apparatus according to an embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve a similar result.

FIG. 1 is a schematic diagram illustrating a configuration of an image forming apparatus according to an embodiment of the present invention. In FIG. 1, an image forming apparatus 20 includes image forming devices 21C, 21Y, 21M, and 21Bk that form images of different colors corresponding to an original image, a transfer device 22 disposed facing the image forming devices 21C, 21Y, 21M, and 21Bk, a manual feed tray 23, paper feed cassettes 24, and registration rollers 31 that serve as sheet medium supply units to supply various sheet media to transfer areas formed between the transfer device 22 and the image forming devices 21C, 21Y, 21M, and 21Bk, respectively, and a fixing device 30 that fixes an image onto a sheet medium after the images of different colors are transferred to the sheet medium in the transfer areas. The registration rollers 31 convey the sheet medium sent from the paper feed cassette 24 in synchrony with an image formation operation performed by the image forming devices 21C, 21Y, 21M, and 21Bk.

The image forming devices 21C, 21Y, 21M, and 21Bk develop images into color images in cyan, yellow, magenta, and black, respectively.

The configuration of the image forming device 21C is now described as representative of the image forming devices 21C, 21Y, 21M, and 21Bk, which all share the same basic configuration and differ only in the color of toner used therein.

The image forming device 21C includes a photosensitive drum 25C serving as a latent electrostatic image bearing member. The image forming device 21C also includes a charging device 27C, a development device 26C, and a cleaning device 28C, which are disposed, in that order, around the photosensitive drum 25C in the direction of rotation of the photosensitive drum 25C, i.e., clockwise in FIG. 1. The photosensitive drum 25C receives irradiation light emitted from a writing device 29 to a point between the charging device 27C and the development device 26C. Instead of a drum, the latent electrostatic image bearing member may alternatively have a belt shape.

Figure 2:
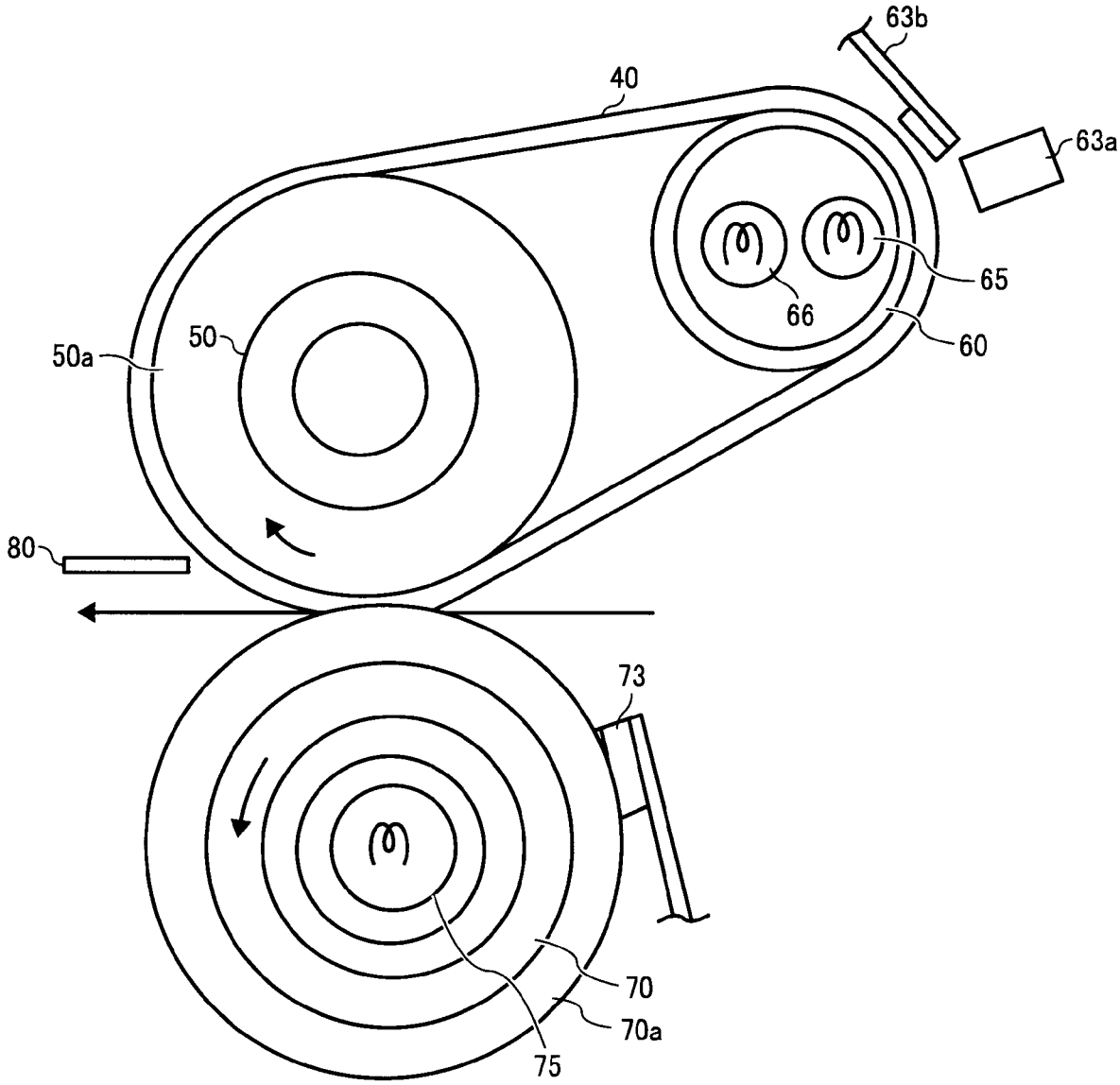
FIG. 2 is a schematic diagram illustrating a configuration of a fixing device according to an embodiment of the present invention.
Figure 3:
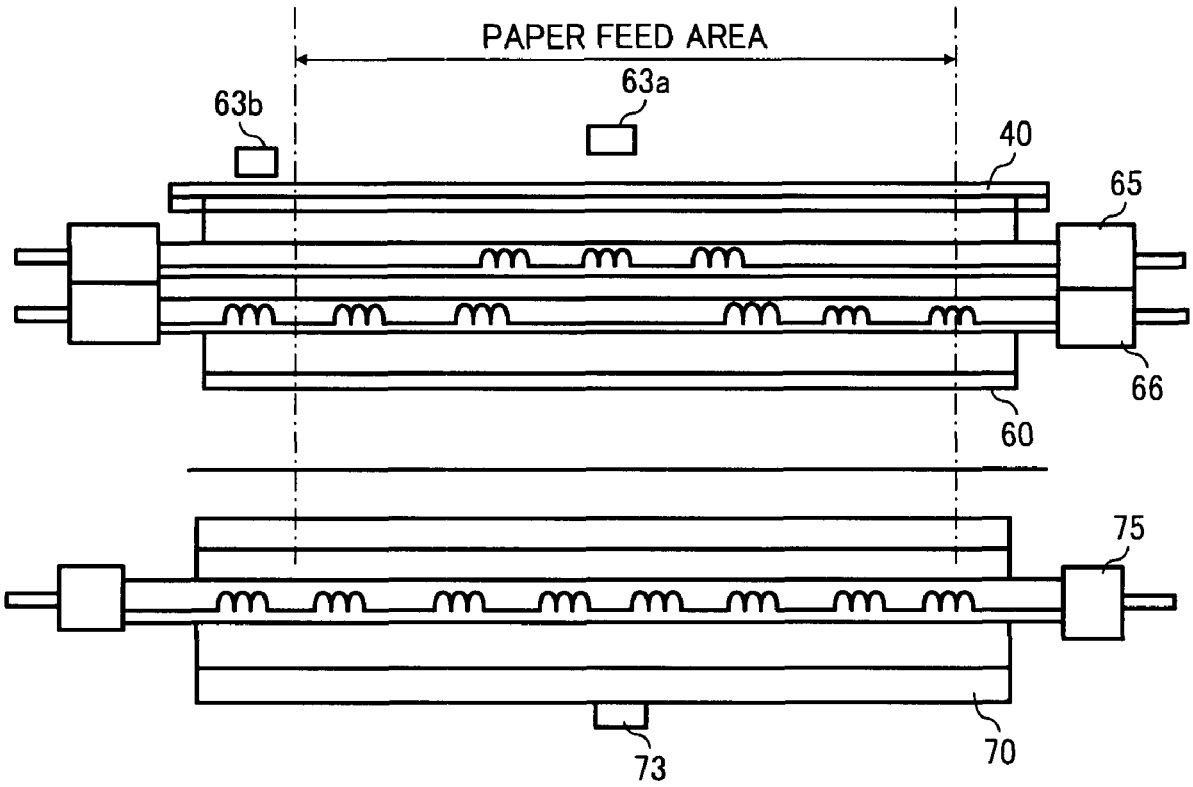
FIG. 3 is a planar cross-sectional diagram illustrating one configuration of the fixing device according to an embodiment of the present invention.

FIG. 2 is a schematic diagram illustrating a configuration of the fixing device according to an embodiment of the present invention, and FIG. 3 is a planar cross-sectional diagram illustrating one configuration of the fixing device according to an embodiment of the present invention.

The fixing device 30 according to an embodiment of the present invention includes a fixing roller 50 and a heat roller 60. The fixing roller 50 is coated with an elastic layer 50*a* formed of rubber or sponge having a surface layer of fluorine resin or fluorine rubber. The heat roller 60 is formed of a metal pipe and includes a first heat source 65 and a second heat source 66. A belt 40 is stretched around the fixing roller 50 and the heat roller 60. The belt 40 includes a substrate of a metal film such as of nickel or stainless steel (SUS according to Japanese Industrial Standard) or a resin film such as of polyimide (PI) or polyamide-imide (PAI), silicone rubber formed on the substrate, and a surface layer of fluorine resin.

The belt (hereinafter referred to as fixing belt) 40 is rotated by the fixing roller 50. A pressure roller 70 rotates in press contact with the fixing roller 50 through the fixing belt 40, which is interposed therebetween. Similarly to the heat roller 60, the pressure roller 70 includes a pressure heat source (hereinafter referred to as pressure heater) 75 and is coated with an elastic layer 70*a* formed of rubber having a surface layer of fluorine resin. Activation of the heat sources 65, 66, and 75 included in the rollers 60 and 70, respectively, is controlled by detecting the temperatures of the fixing belt 40 stretched around the rollers 60 and 50 and the pressure roller 70 using a first temperature detection sensor 63*a*, a second temperature detection sensor 63*b*, and a pressure temperature detection sensor 73, respectively. Heat and pressure are applied from the fixing belt 40 heated by the heat roller 60 to paper with a toner image formed thereon in a nip portion where the fixing roller 50 and the pressure roller 70 are pressed against each other and the elastic layers 50*a* and 70*a* are deformed, thereby fixing the toner onto the paper. The paper is then separated from the roller by a separation plate 80 and conveyed.

Figure 4:
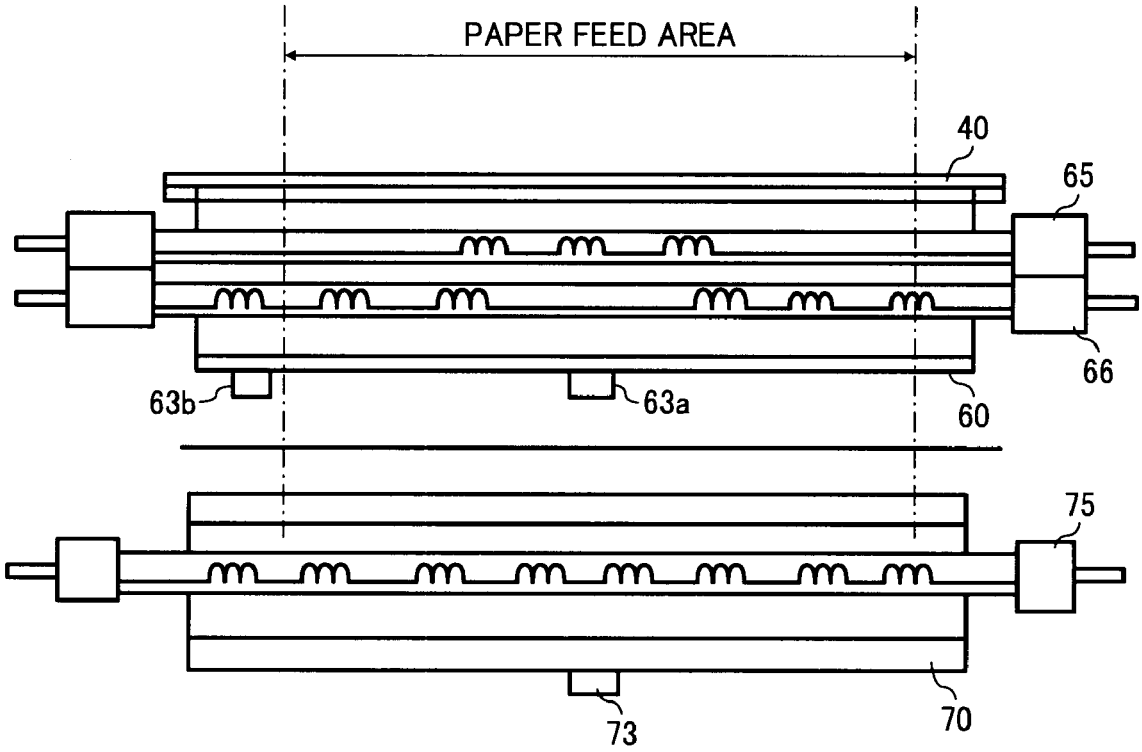
FIG. 4 is a planar cross-sectional diagram illustrating another configuration of the fixing device according to an embodiment of the present invention.

FIG. 4 is a planar cross-sectional diagram illustrating another configuration of the fixing device according to an embodiment of the present invention. In the embodiment illustrated in FIG. 4, the temperature of the heat roller 60 is measured using the first temperature detection sensor 63*a* and the second temperature detection sensor 63*b* that are disposed in contact with the heat roller 60 to control the temperature of the heat roller 60. The first temperature detection sensor 63*a* and the second temperature detection sensor 63*b* may alternatively be disposed out of contact with the surface of the heat roller 60.

It should be noted that the fixing device 30 may alternatively be a heat roller fixing device that uses a fixing roller 50 including a heater as a substitute for the heat roller 60, without using the fixing belt 40.

To reduce or prevent an increase in the temperature of an end portion of the fixing belt 40 due to paper size, i.e., while continuously feeding narrow paper, the fixing device 30 includes the first heat source (hereinafter referred to as center heater) 65, which is a halogen heater that mainly irradiates a center portion of a paper feed area, the first temperature detection sensor (hereinafter referred to as center temperature detector) 63*a* that detects the temperature of the center portion of the paper feed area on the fixing belt 40 to control activation of the center heater 65 based on a set temperature of the center portion, the second heat source (hereinafter referred to as end heater) 66, which is a halogen heater that mainly irradiates the end portion of the paper feed area, and the second temperature detection sensor (hereinafter referred to as end temperature detector) 63*b* that detects the temperature of the end portion of the paper feed area on the fixing belt 40 or the temperature of the fixing belt 40 outside the paper feed area to control activation of the end heater 66 based on a set temperature of the end portion. The fixing device 30 also includes the pressure heater 75, which is a halogen heater, and the pressure temperature detection sensor (pressure temperature detector) 73 that detects the temperature of the paper feed area on the pressure roller 70 to control activation of the pressure heater 75 based on a set temperature thereof. The center heater 65, the end heater 66, and the pressure heater 75 are intermittently activated at short intervals in response to an activation command (hereinafter referred to as duty control) to control power consumption. It should be noted that the heater is not limited to the halogen heater using a halogen lamp and may use an electrically-heated wire. In this case, similarly to the halogen heater, the heater using an electrically-heated wire is controllable by adjusting the number of turns of the electrically-heated wire. The present description is of a halogen heater.

In the above-described configuration, most of the heat of the fixing belt 40 applied to paper for fixing is lost to the paper since heat is easily transferred to a contacting substance and the elastic layer 50*a*, which also contacts the fixing belt 40, has a low thermal conductivity.

The elastic layer 70*a* also has a low thermal conductivity, thereby preventing immediate transfer of heat of the pressure heater 75 to the fixing belt 40. Therefore, a heater efficiency is maximized when the heaters 65 and 66 included in the heat roller 60 formed of a metal pipe with a high thermal conductivity and not containing silicone rubber are used to supply heat during continuous paper feed. The heaters are controlled as described above during paper feed.

FIGS. 5 to 11 are graphs illustrating changes in temperatures of each portion of the fixing belt and the pressure roller or actual outputs of each heater. The data of the temperatures are obtained by using a temperature indicator and temperature probes disposed at seven points on the fixing belt 40 where the lead line of reference numeral 60 illustrated in FIG. 2 intersects the surface layer of the fixing belt 40. Specifically, the seven temperature probes are disposed in the width direction including two temperature probes disposed outside the paper feed area, four temperature probes disposed in the paper feed area, and one temperature probe disposed at the center. The data of heater outputs are obtained by using a current probe provided to each heater wire that measures electrical current and an electrical power measurement device that converts amperage to wattage and feeding 64 g/m$^2$ to 105 g/m$^2$ paper of, for example, B5T, A4T, B4T, A4Y, and A3 size.

Figure 5:
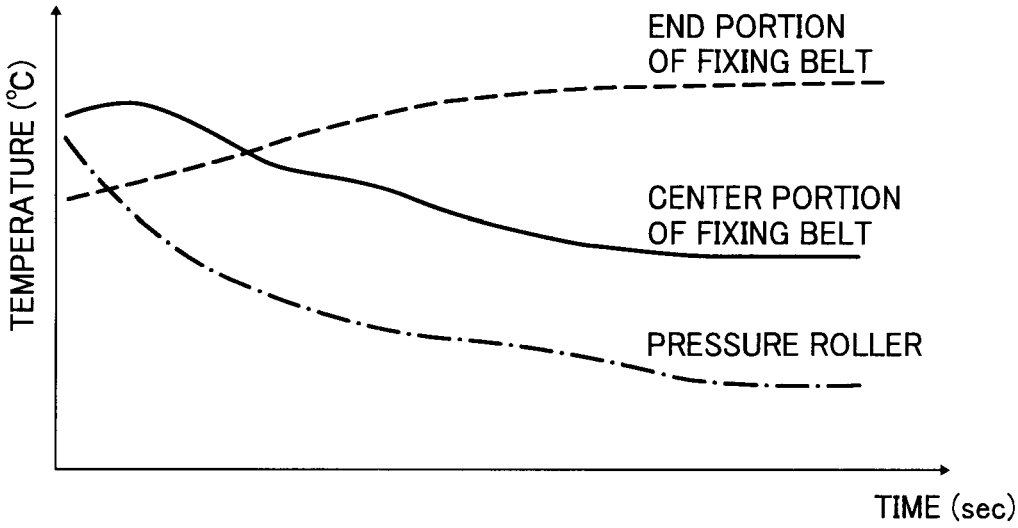
FIG. 5 is a graph illustrating changes in temperatures of a center portion and an end portion of a fixing belt and a pressure roller included in the fixing device during paper feed.

FIG. 5 is a graph illustrating changes in the temperatures of the center portion and the end portion of the fixing belt and the pressure roller included in the fixing device during paper feed. In the embodiment of the present invention, the heaters 65, 66, and 75 are controlled using the temperature detectors 63*a*, 63*b*, and 73, respectively, during paper feed. When heat is lost to paper, the heaters 65 and 66 are activated, thereby compensating for the heat loss and maintaining the set temperature.

The temperature of the end portion of the fixing belt 40 is raised during continuous paper feed since the end portion does not lose heat to paper or the end portion is adjacent to the portion losing heat. When the temperature of the end portion continues to rise, the temperature may exceed an allowable temperature for the fluorine resin contained in the surface layer or a hot offset may occur at the end portion with paper with a maximum size fed immediately after the temperature increase. When such problem occurs in the fixing device using the center heater 65 that mainly irradiates the center portion of the paper feed area and the end heater 66 that mainly irradiates the end portion of the paper feed area, the temperature increase in the end portion of the fixing belt 40 is reduced by reducing a heating value per unit time of the end heater 66.

The number of sheets of paper fed to the fixing device per unit time increases in a high-speed image forming apparatus. However, a power supply situation may limit maximum power consumption and reduce allowable electrical power for the fixing device particularly during paper feed compared with during starting of the fixing device. There are typical techniques for reducing heater power consumption during paper feed, such as by manipulation of the duty control, i.e., by intermittent activation of the heater at short intervals in response to an activation command, or by reducing power consumption of the fixing device using a plurality of heaters according to a change in allowable electrical power due to paper size. When the allowable electrical power for the fixing device is further limited, the fixing device responds by changing the allowable electrical power for the fixing device and adjusting the productivity according to the mode of operation, such as during monochrome printing, color printing, or scanning and irradiating. In this case, the productivity is adjusted by changing a distance between successive sheets of paper according to a temperature-stable performance of each of the heaters 65 and 66 with a controlled duty cycle. Therefore, it is desirable that the temperature of the heat roller 60 be maintained with a minimal amount of electrical power.

However, in the above-described typical technique, for example, when the temperature of the end portion of the fixing belt 40 heated by the end heater 66 exceeds a set temperature thereof while the temperature of the center portion of the fixing belt 40 heated by the center heater 65 remains below a set temperature thereof, the end heater 66 may be turned off and the center heater 65 may be fully activated. In this case, however, even with the heater wattage at full activation for the center heater 65, less than the allowable electrical power for the fixing device is being used. Also, the heat transfer through the fixing roller 60 from the end portion to the center portion stops by turning off the end heater 66. Therefore, the temperature of the center portion of the fixing belt 40 may not be raised. By contrast, when the heater wattage for full activation of the center heater 65 is equal to or greater than the allowable electrical power for the fixing device, the center heater 65 cannot be activated in a mode in which the allowable electrical power for the fixing device is reduced.

Figure 6:
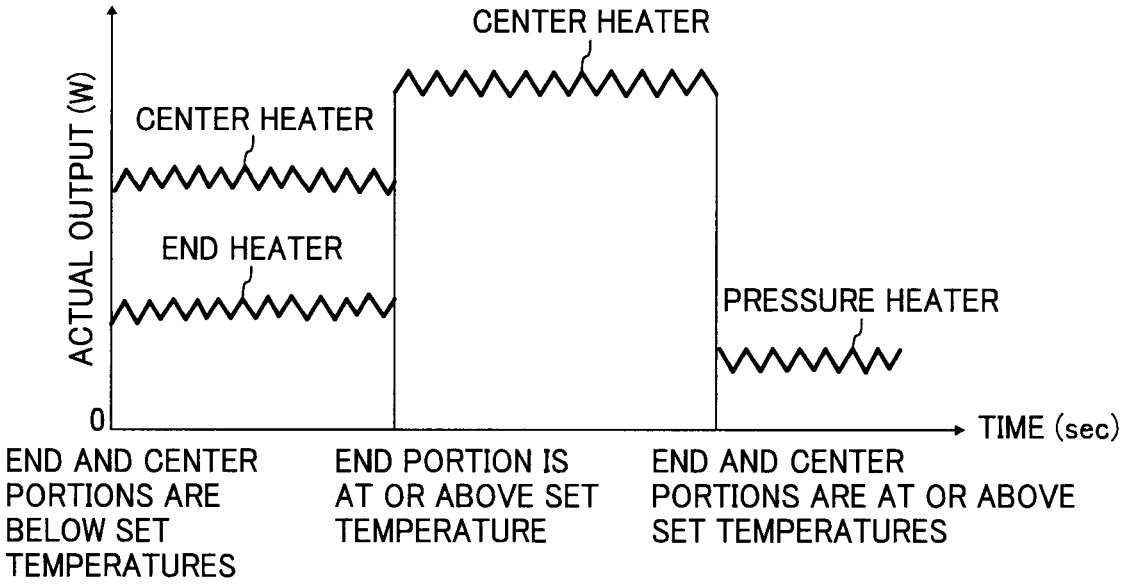
FIG. 6 is a graph illustrating changes in actual outputs of a center heater and an end heater of a heat roller and a pressure heater included in the fixing device according to an embodiment of the present invention.

FIG. 6 is a graph illustrating changes in the actual outputs of the center heater and the end heater of the heat roller and the pressure heater included in the fixing device according to an embodiment of the present invention. According to the embodiment of the present invention, when one of the temperature detectors 63*a* and 63*b* detects a temperature at or above the set temperature, the heater 65 or 66 is turned off so that the electrical power used for the turned-off heater is divided and added to the other heaters including the pressure heater 75 to increase the duty ratios thereof.

Typically, the temperature of the end portion of the fixing belt 40 is raised by continuous paper feed. When the end temperature detector 63*b* detects a temperature at or above the set temperature, the end heater 66 is turned off. For example, the center heater 65 has a 700 W (watt) rating and operates at a duty ratio of 50% and the end heater 66 has a 600 W rating and operates at a duty ratio of 50%. The temperature of the center portion of the fixing belt 40 is sharply lowered due to heat loss caused by paper feed. When the end heater 66 is turned off, an electrical power of 300 W is saved. The saved electrical power of 300 W is converted into the duty ratio of the center heater 65, which is 300 W/700 W×100%=42.9%. Therefore, the center heater 65, which is originally activated at a duty ratio of 50%, is now activated at a duty ratio of 42.9%+50%=92.9%, thereby responding to the decrease in the temperature.

The pressure heater 75 is not activated during paper feed in terms of a fixing efficiency. Therefore, the temperature thereof is lowered even when the heat supplied by the heaters 65 and 66 is greater than the heat lost to the paper. The heat roller 60 maintains the set temperature thereof while using the maximum available electrical power. However, the temperature of the heat roller 60 reaches the set temperature only between sheets of paper and is lowered below the set temperature when the paper passes the nip portion. By turning off the heaters 65 and 66, an electrical power of 700 W×92.9%=650 W is saved and applied to the pressure heater 75. Although the efficiency is approximately one sixth of that of the heat roller 60, heat is thus applied to the paper passing through the nip portion, thereby helping the fixing process.

As described above, the heater efficiency is improved as much as possible while controlling the duty cycle of at least one of the heaters 65, 66, and 75 during paper feed, thereby reducing the waste of electrical power, maintaining the fixing ability, and ensuring a high productivity.

When the temperature detected by the end temperature detector 63*b* is at or above the set temperature of the end portion of the fixing belt 40 during paper feed, the duty ratio of the center heater 65 is increased by an amount corresponding to the wattage used for the end heater 66. When the temperature detected by the center temperature detector 63*a* is at or above the set temperature of the center portion of the fixing belt 40 during paper feed, the duty ratio of the end heater 66 is increased by an amount corresponding to the wattage used for the center heater 65. When the temperatures detected by the center temperature detector 63*a* and the end temperature detector 63*b* are at or above the set temperatures of the center portion and the end portion, respectively, during paper feed, the duty ratio of the pressure heater 75 is increased. During paper feed, heat is applied to the paper by the heat roller 60 via the fixing belt 40 and the pressure roller 70. However, the temperature of the heat roller 60 has a larger effect on the fixing process than the pressure roller 70 since the heat roller 60 is disposed on the side directly contacting toner on paper. When the temperature of the pressure roller 70 is extremely low, the heat of the paper is lost to the pressure roller 70 and the temperature of the surface of the paper is sharply lowered. When the temperature of the pressure roller 70 is at or above approximately 100° C., the pressure roller 70 has little influence on the temperature of the paper.

When the temperature of one of the center portion and the end portion of the fixing belt 40 reaches the set temperature thereof and the temperature of the other one of the center portion and the end portion of the fixing belt 40 is below the set temperature thereof, the electrical power used for one of the heaters 65 and 66 heating the portion with a temperature at or above the set temperature is applied to the other one of the heaters 65 and 66 heating the portion with a temperature below the set temperature to increase the duty ratio of the other heater, thereby efficiently reducing the waste of electrical power. When the temperatures of the center portion and the end portion of the fixing belt 40 reach the set temperatures, even though a sufficient fixing ability is maintained, the electrical power used for the heaters 65 and 66 is applied to the pressure heater 75 of the pressure roller 70 losing heat due to paper feed to increase the duty ratio of the pressure heater 75. Consequently, heat is stored in the pressure heater 75 with a heat capacity and used for subsequent paper feed requiring a large amount of electrical power for fixing.

As described above, the heater efficiency is improved as much as possible while controlling the duty cycle of at least one of the heaters 65, 66, and 75 during paper feed, thereby reducing the waste of electrical power, maintaining the fixing ability, and ensuring a high productivity.

When the temperature detected by the end temperature detector 63*b* is at or above the set temperature of the end portion during paper feed, the duty ratio of the center heater 65 is increased by an amount corresponding to the wattage used for the end heater 66. When the temperature detected by the center temperature detector 63*a* is at or above the set temperature of the center portion, the duty ratio of the end heater 66 and the duty ratio of the pressure heater 75 are increased by dividing the wattage used for the center heater 65.

Figure 7:
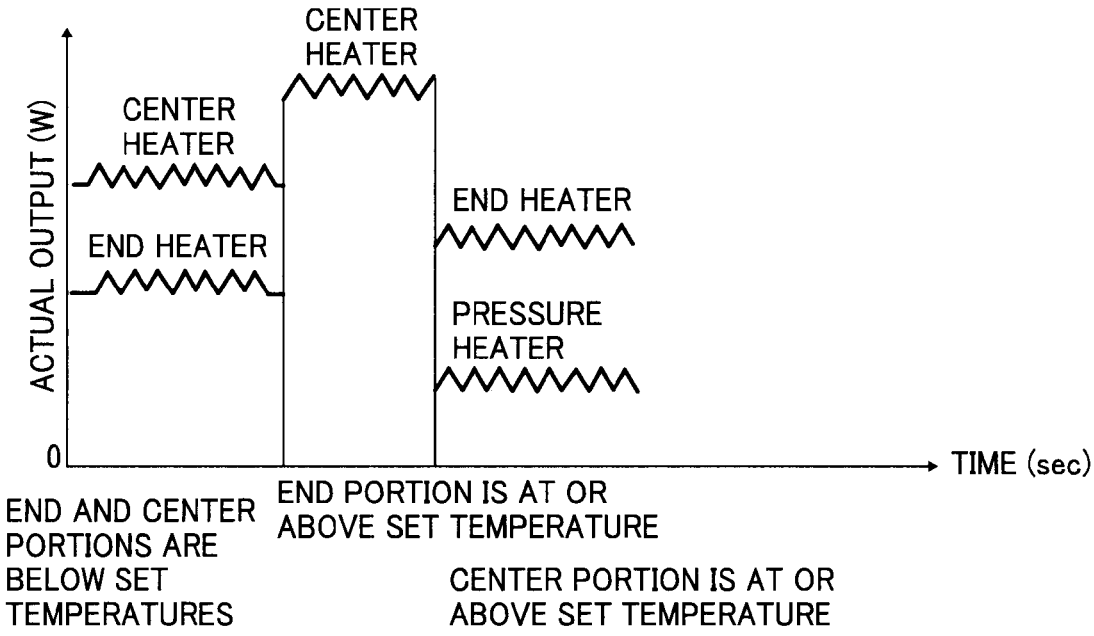
FIG. 7 is a graph illustrating changes in the actual outputs of the center heater and the end heater of the heat roller and the pressure heater included in the fixing device according to an embodiment of the present invention.

FIG. 7 is a graph illustrating changes in the actual outputs of the center heater and the end heater of the heat roller and the pressure heater included in the fixing device according to an embodiment of the present invention. Generally, the center heater 65 has a high wattage rating and the end heater 66 has a low wattage rating in terms of temperature distribution during paper feed. This is because, when the center heater 65 has a too short effective light emission length, the temperature is raised at the end portion when feeding paper with a middle size between maximum and minimum paper feed widths.

In the above-described configuration, when the temperature of the end portion reaches the set temperature thereof during paper feed, the wattage of the end heater 66 is used to activate the center heater 65 at a duty ratio of less than 100 percent. However, when the temperature of the center portion reaches the set temperature thereof, the wattage of the center heater 65 is more than the wattage for 100 percent full activation of the end heater 66. The surplus is applied to the pressure heater 75 so that heat is stored in the pressure heater 75 with a heat capacity and used for subsequent paper feed requiring a large amount of electrical power for fixing.

As described above, the heater efficiency is improved as much as possible while controlling the duty cycle of at least one of the heaters 65, 66, and 75 during paper feed, thereby reducing the waste of electrical power, maintaining the fixing ability, and ensuring a high productivity.

It should be noted that although the duty ratios of the end heater 66 and the pressure heater 75 are both increased in the above-described example illustrated in FIG. 7, alternatively, the duty ratio of only one of the end heater 66 and the pressure heater 75 may be increased.

While the temperature detected by the center temperature detector 63*a* is below the set temperature of the center portion (hereinafter referred to as the temperature A) during paper feed, the end heater 66 is activated at a default duty ratio G when the temperature detected by the end temperature detector 63*b* is below a temperature D set below the set temperature of the end portion (hereinafter referred to as the temperature B), and is activated at a duty ratio H, which is smaller than the duty ratio G, when the temperature detected by the end temperature detector 63*b* is at or above the temperature D and below the temperature B.

Figure 8:
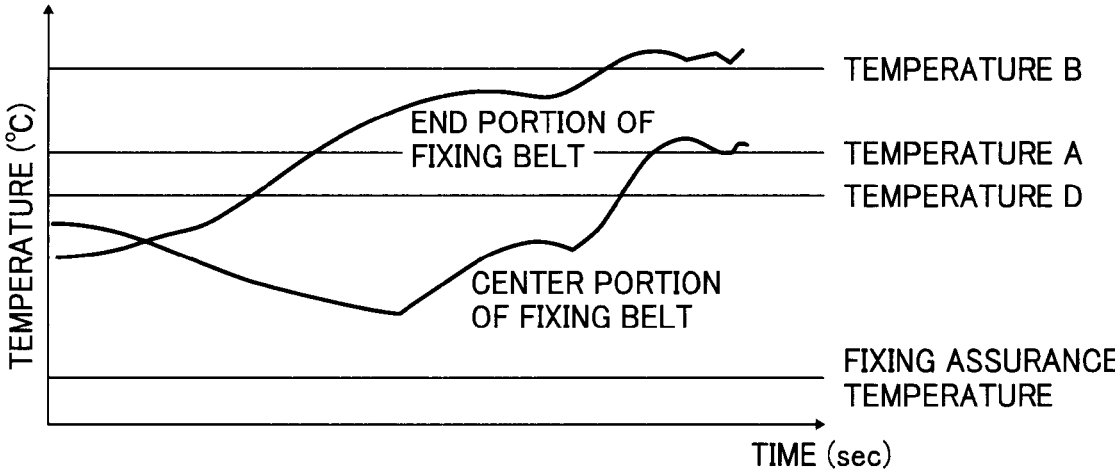
FIG. 8 is a graph illustrating changes in the temperatures of the center portion and the end portion of the fixing belt included in the fixing device during paper feed.

FIG. 8 is a graph illustrating changes in the temperatures of the center portion and the end portion of the fixing belt included in the fixing device according to an embodiment of the present invention during paper feed. In a standby mode, the end portion loses heat and the center portion substantially retains heat. Consequently, the temperature tends to be high at the center portion and low at the end portion. By contrast, the temperature of the end portion is raised by continuous paper feed and the temperature of the center portion is lowered by heat loss to paper. Therefore, the temperature detected by the end temperature detector 63*b* tends to be higher than the temperature detected by the center temperature detector 63*a* during paper feed. The heat of the end heater 66 is transferred through the heat roller 60, thereby partially serving to maintain the temperature of the center portion. The temperature cannot be maintained at the center portion when the end heater 66 is turned off. Therefore, the temperature B is generally set to be higher than the temperature A to maintain the temperature of the center portion and ensure the fixing ability. Accordingly, when the temperature detected by the end temperature detector 63*b* is at or above a fixing assurance temperature and at or below the set temperature, the temperature detected by the center temperature detector 63*a* is lowered closer to the fixing assurance temperature than the temperature detected by the end temperature detector 63*b*.

Figure 9:
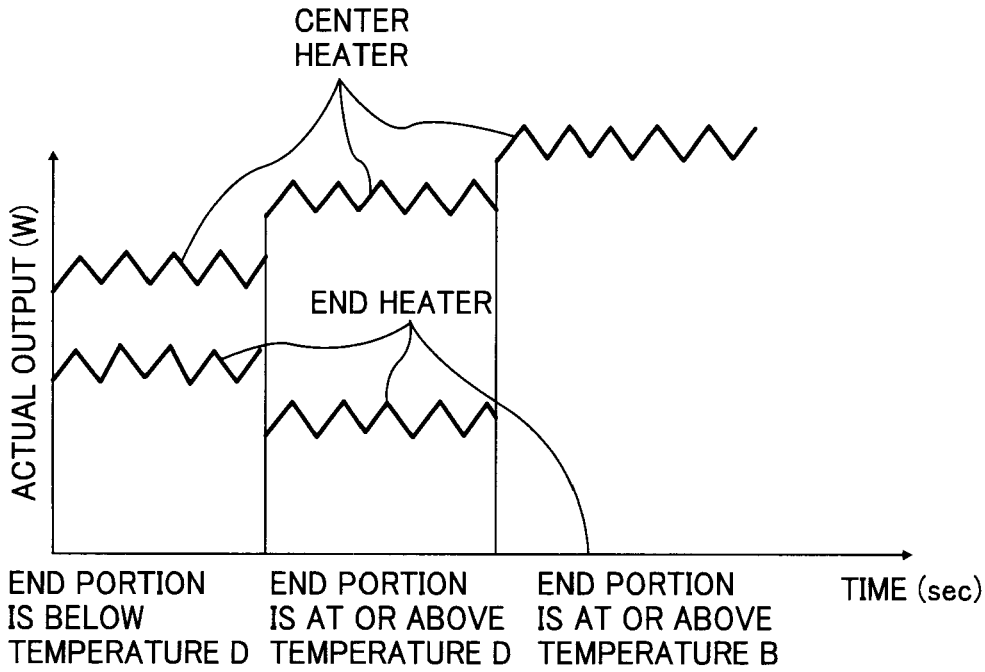
FIG. 9 is a graph illustrating changes in the actual outputs of the center heater and the end heater of the heat roller included in the fixing device according to an embodiment of the present invention.

FIG. 9 is a graph illustrating changes in the actual outputs of the center heater and the end heater of the heat roller included in the fixing device according to an embodiment of the present invention. In this example, the end heater 66 has a 600 W rating and operates at a default duty ratio G of 50% or a duty ratio H of 30% and the center heater 65 has a 700 W rating and operates at a default duty ratio of 50%. By activating the end heater 66 at the duty ratio H, a saved electrical power of 120 W is converted and added to the default duty ratio of the center heater 65, thereby activating the center heater 65 at a duty ratio of 67.1% and raising the temperature of the center portion.

Therefore, the heater efficiency is improved as much as possible while controlling the duty cycle of at least one of the heaters 65, 66, and 75 during paper feed, thereby reducing the waste of electrical power, maintaining the fixing ability, and ensuring a high productivity.

Figure 10:
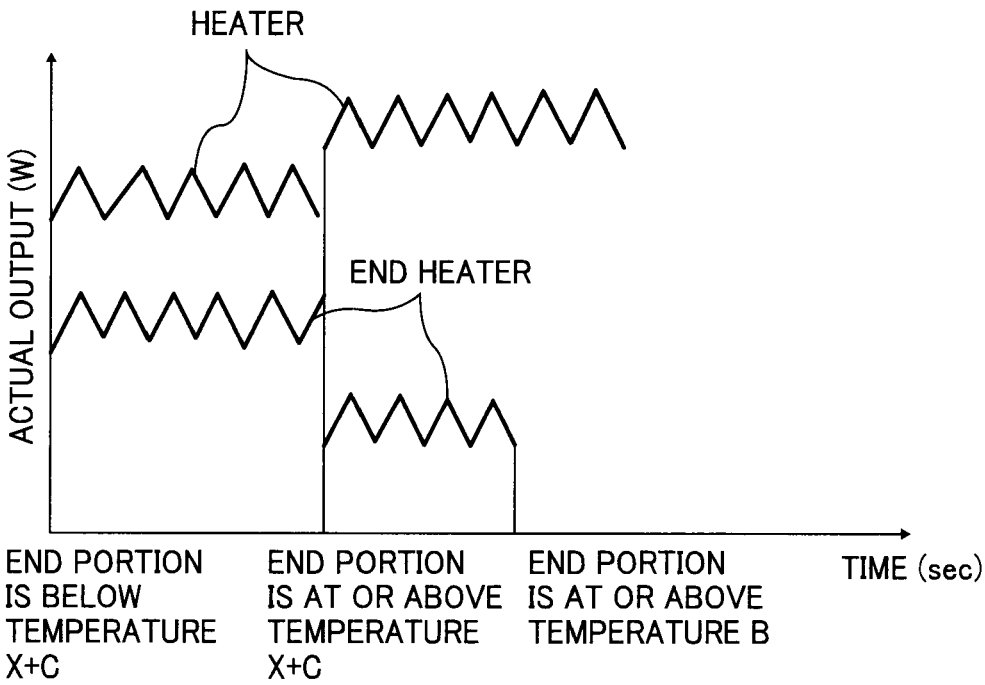
FIG. 10 is a graph illustrating changes in the actual outputs of the center heater and the end heater of the heat roller included in the fixing device according to an embodiment of the present invention.
Figure 11:
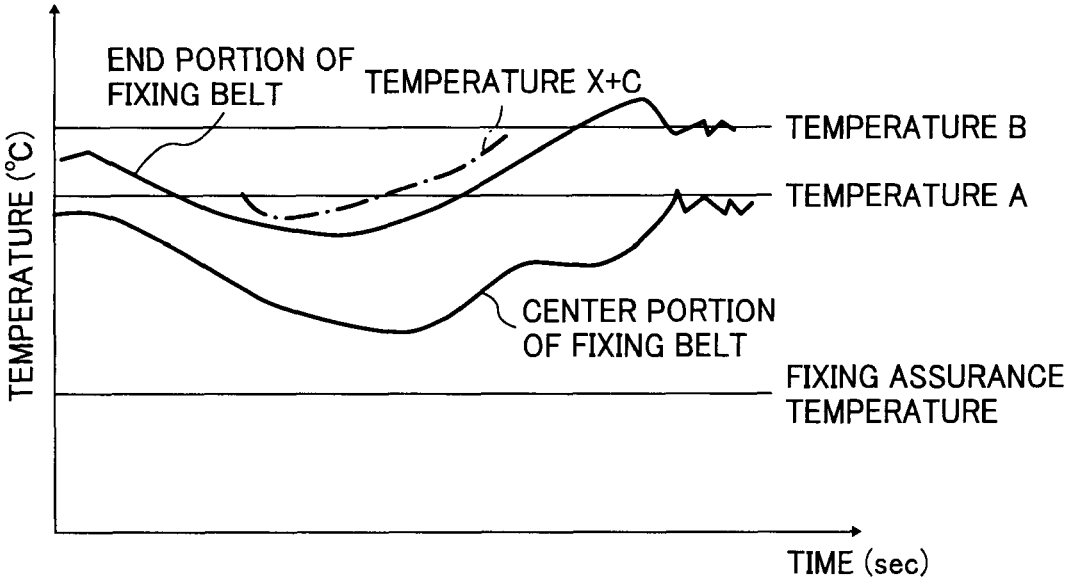
FIG. 11 is a graph illustrating changes in the temperatures of the center portion and the end portion of the fixing belt included in the fixing device during paper feed.

FIG. 10 is a graph illustrating changes in the actual outputs of the center heater and the end heater of the heat roller included in the fixing device according to an embodiment of the present invention. FIG. 11 is a graph illustrating changes in the temperatures of the center portion and the end portion of the fixing belt included in the fixing device according to an embodiment of the present invention during paper feed.

While the temperature detected by the center temperature detector 63*a* is below the temperature A during paper feed, the end heater 66 is activated at a default duty ratio G when the temperature detected by the end temperature detector 63*b* is below a target temperature X+C, where X is a measured value of the temperature detected by the center temperature detector 63*a* during paper feed and C is a difference between the temperature A and the temperature B, and is activated at a duty ratio H, which is smaller than the duty ratio G, when the temperature detected by the end temperature detector 63*b* is at or above the temperature X+C and below the set temperature B.

For example, when the temperature A is 170° C. and the temperature B is 180° C., the temperature B is 10° C. higher than the temperature A. When the measured value X of the temperature of the center portion is 160° C., which is higher than a fixing assurance temperature of 140° C., during paper feed, the value of the target temperature X+C is 160° C.+10° C.=170° C. Accordingly, the end heater 66 is activated at the duty ratio H smaller than the duty ratio G at or above 170° C. and below 180° C. Therefore, a constant temperature distribution is continuously maintained even when the temperature is below the set temperature during paper feed. As a result, the temperature of the fixing belt 40 is maintained by using maximum energy of the heaters 65 and 66 to fix toner onto paper. Therefore, the heater efficiency is improved as much as possible while controlling the duty cycle of at least one of the heaters 65, 66, and 75 during paper feed, thereby reducing the waste of electrical power, maintaining the fixing ability, and ensuring a high productivity.

When a duty ratio I obtained by dividing the product of a wattage M of the end heater 66 multiplied by the duty ratio G of the end heater 66 by a wattage N of the center heater 65 is added to a default duty ratio J of the center heater 65, the total (I+J) may exceed 100 percent. In this case, the duty ratio H is a reconverted value of a surplus above 100 percent.

For example, the end heater 66 has a 600 W rating and is activated at a default duty ratio G of 80% and the center heater 65 has a 700 W rating and is activated at a default duty ratio J of 80%. The default output of the end heater 66 is 480 W and the default output of the center heater 65 is 560 W. The end heater 66 is turned off and the default output of the end heater 66 is added to the default output of the center heater 65, making a total of 1,040 W, which is 340 W higher than 700 W for 100 percent full activation of the center heater 65. Therefore, the surplus of 340 W is returned to the end heater 66, activating the end heater 66 at a duty ratio of 340 W/600 W=56.7%. Therefore, decrease in the temperature of the center portion is prevented without sharply lowering the temperature of the end portion. Therefore, the heater efficiency is improved as much as possible while controlling the duty cycle of at least one of the heaters 65, 66, and 75 during paper feed, thereby reducing the waste of electrical power, maintaining the fixing ability, and ensuring a high productivity.

Figure 12:
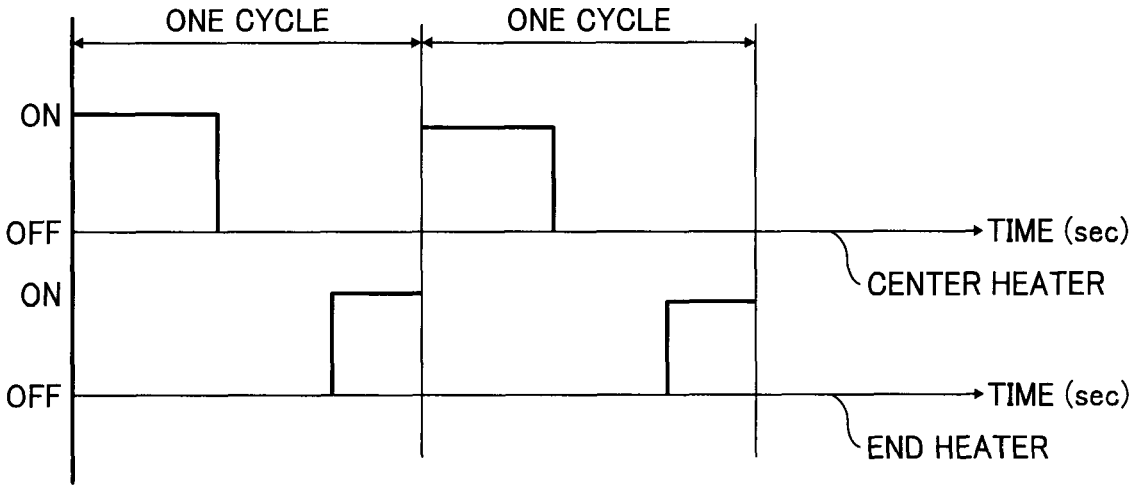
FIG. 12 is a graph illustrating an actual output of the center heater turned on at a beginning of a cycle and an actual output of the end heater turned on at an end of the cycle.

FIG. 12 is a graph illustrating an actual output of the center heater turned on at a beginning of a cycle and an actual output of the end heater turned on at an end of the cycle. Specifically, the duty ratio J of the center heater 65 and the duty ratio G of the end heater 66 are at a beginning and an end, respectively, in a cycle.

When the heaters 65 and 66 are simultaneously activated, inrush currents are superimposed, thereby increasing an apparent electrical power. By turning on the heaters respectively at a beginning and an end of a cycle, the inrush currents of the two heaters are not superimposed, thereby reducing the waste of electrical power due to the inrush currents. In this case, only an inrush current of a heater with a largest wattage rating and under duty control for fixing is counted. For example, when the center heater 65 has a 700 W rating and the end heater 66 has a 600 W rating, only the inrush current of the center heater 65 with a 700 W rating is counted. Consequently, the electrical power is not increased by the inrush currents, thereby reducing the waste of electrical power.

As can be understood by those skilled in the art, numerous additional modifications and variations are possible in light of the above teachings. It is therefore to be understood that, within the scope of the appended claims, the disclosure of this patent specification may be practiced otherwise than as specifically described herein.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program or computer program product. For example, the aforementioned methods may be embodied in the form of a system or device, including, but not limited to, any of the structures for performing the methodology illustrated in the drawings.

Example embodiments being thus described, it will be apparent that the same may be varied in many ways. Such variations are not to be regarded as a departure from the spirit and scope of the present invention, and all such modifications as would be obvious to one skilled in the art are intended to be included within the scope of the following claims.

What is claimed is:

1. A fixing device, comprising:

a fixing roller;

a heat roller including a first heat source and a second heat source, the first heat source including a first halogen heater configured to primarily irradiate a center portion of a paper feed area and the second heat source including a second halogen heater configured to primarily irradiate an end portion of the paper feed area;

a fixing belt stretched around the fixing roller and the heat roller;

a pressure roller comprising a pressure heat source including a third halogen heater and configured to rotate in press contact with the fixing roller;

a first temperature detector configured to detect a temperature of the center portion of the paper feed area on the fixing belt, which is used to control activation of the first heat source based on a first set temperature of the center portion;

a second temperature detector configured to detect a temperature of the end portion of the paper feed area on the fixing belt or a temperature of the fixing belt outside the paper feed area, which is used to control activation of the second heat source based on a second set temperature of the end portion; and a pressure temperature detector configured to detect a temperature of the paper feed area on the pressure roller, which is used to control activation of the pressure heat source based on a third set temperature of the paper feed area, wherein the halogen heaters are configured to be switched on and off at regular intervals according to a cycle to reduce power consumption, and at least one of the halogen heaters is controlled according to the cycle during paper feed;

a duty ratio of the first heat source is increased by an amount corresponding to a wattage used for the second heat source when the temperature detected by the second temperature detector is at or above the second set temperature during paper feed; and a duty ratio of one of the second heat source and the pressure heat source is increased by an amount corresponding to a wattage used for the first heat source when the temperature detected by the first temperature detector is at or above the first set temperature during paper feed.

2. A fixing device, comprising:

a fixing roller;

a heat roller including a first heat source and a second heat source, the first heat source including a first halogen heater configured to primarily irradiate a center portion of a paper feed area and the second heat source including a second halogen heater configured to primarily irradiate an end portion of the paper feed area;

a fixing belt stretched around the fixing roller and the heat roller;

a pressure roller comprising a pressure heat source including a third halogen heater and configured to rotate in press contact with the fixing roller;

a first temperature detector configured to detect a temperature of the center portion of the paper feed area on the fixing belt, which is used to control activation of the first heat source based on a first set temperature of the center portion;

a second temperature detector configured to detect a temperature of the end portion of the paper feed area on the fixing belt or a temperature of the fixing belt outside the paper feed area, which is used to control activation of the second heat source based on a second set temperature of the end portion; and a pressure temperature detector configured to detect a temperature of the paper feed area on the pressure roller, which is used to control activation of the pressure heat source based on a third set temperature of the paper feed area, wherein the halogen heaters are configured to be switched on and off at regular intervals according to a cycle to reduce power consumption, and at least one of the halogen heaters is controlled according to the cycle during paper feed;

a duty ratio of the first heat source is increased by an amount corresponding to a wattage used for the second heat source when the temperature detected by the second temperature detector is at or above the second set temperature during paper feed;

a duty ratio of the second heat source is increased by an amount corresponding to a wattage used for the first heat source when the temperature detected by the first temperature detector is at or above the first set temperature during paper feed; and a duty ratio of the pressure heat source is increased when the temperatures detected by the first temperature detector and the second temperature detector are at or above the first and second set temperatures, respectively, during paper feed.

3. A fixing device, comprising:

a fixing roller;

a heat roller including a first heat source and a second heat source, the first heat source including a first halogen heater configured to primarily irradiate a center portion of a paper feed area and the second heat source including a second halogen heater configured to primarily irradiate an end portion of the paper feed area;

a fixing belt stretched around the fixing roller and the heat roller;

a pressure roller comprising a pressure heat source including a third halogen heater and configured to rotate in press contact with the fixing roller;

a first temperature detector configured to detect a temperature of the center portion of the paper feed area on the fixing belt, which is used to control activation of the first heat source based on a first set temperature of the center portion;

a second temperature detector configured to detect a temperature of the end portion of the paper feed area on the fixing belt or a temperature of the fixing belt outside the paper feed area, which is used to control activation of the second heat source based on a second set temperature of the end portion; and a pressure temperature detector configured to detect a temperature of the paper feed area on the pressure roller, which is used to control activation of the pressure heat source based on a third set temperature of the paper feed area, wherein the halogen heaters are configured to be switched on and off at regular intervals according to a cycle to reduce power consumption, and at least one of the halogen heaters is controlled according to the cycle during paper feed; and while the temperature detected by the first temperature detector is below the first set temperature during paper feed, the second heat source is activated at a first duty ratio when the temperature detected by the second temperature detector is below a predetermined temperature set below the second set temperature, and is activated at a second duty ratio, which is smaller than the first duty ratio, when the temperature detected by the second temperature detector is at or above the predetermined temperature and below the second set temperature.

4. The fixing device according to claim 1, wherein, while the temperature detected by the first temperature detector is below the first set temperature during paper feed, the second heat source is activated at a first duty ratio when the temperature detected by the second temperature detector is below a target temperature X+C, where X is a temperature detected by the first temperature detector during paper feed and C is a difference between the first and second set temperatures, and is activated at a second duty ratio, which is smaller than the first duty ratio, when the temperature detected by the second temperature detector is at or above the target temperature X+C and below the second set temperature.

5. The fixing device according to claim 3, wherein, when a sum of a duty ratio obtained by dividing a product of a wattage of the second heat source multiplied by the first duty ratio by a wattage of the first heat source plus a default duty ratio of the first heat source exceeds 100 percent, the second duty ratio is a reconverted value of a surplus above 100 percent.

6. The fixing device according to claim 5, wherein the first heat source is activated at a beginning of the cycle and the second heat source is activated at an end of the cycle.

7. An image forming apparatus comprising:

an image bearing member on which a latent image is formed;

a charging device configured to uniformly charge a surface of the image bearing member;

an irradiation device configured to irradiate the charged surface of the image bearing member with light to write the latent image thereon;

a development device configured to visualize the latent image formed on the surface of the image bearing member with toner;

a transfer device configured to transfer the visualized toner image from the surface of the image bearing member to a transfer material directly or via an intermediate transfer member; and the fixing device of claim 1 configured to fix the toner image onto the transfer material.

8. A temperature control method for controlling a temperature of a fixing device, the fixing device including a heat roller including a first heat source and a second heat source, the first heat source including a first halogen heater configured to primarily irradiate a center portion of a paper feed area and the second heat source including a second halogen heater configured to primarily irradiate an end portion of the paper feed area;

a pressure roller including a pressure heat source including a third halogen heater and configured to rotate in press contact with a fixing roller;

a first temperature detector configured to detect a temperature of the center portion of the paper feed area on a fixing belt, which is used to control activation of the first heat source based on a first set temperature of the center portion;

a second temperature detector configured to detect a temperature of the end portion of the paper feed area on the fixing belt or a temperature of the fixing belt outside the paper feed area, which is used to control activation of the second heat source based on a second set temperature of the end portion; and a pressure temperature detector configured to detect a temperature of the paper feed area on the pressure roller, which is used to control activation of the pressure heat source based on a third set temperature of the paper feed area, the temperature control method comprising:

switching the halogen heaters on and off at regular intervals according to a cycle to reduce power consumption while controlling at least one of the halogen heaters according to the cycle during paper feed;

increasing a duty ratio of the first heat source by an amount corresponding to a wattage used for the second heat source when the temperature detected by the second temperature detector is at or above the second set temperature during paper feed; and increasing a duty ratio of one of the second heat source and the pressure heat source by an amount corresponding to a wattage used for the first heat source when the temperature detected by the first temperature detector is at or above the first set temperature during the paper feed.

9. An image forming apparatus, comprising:

an image bearing member on which a latent image is formed;

a charging device configured to uniformly charge a surface of the image bearing member;

an irradiation device configured to irradiate the charged surface of the image bearing member with light to write the latent image thereon;

a development device configured to visualize the latent image formed on the surface of the image bearing member with toner;

a transfer device configured to transfer the visualized toner image from the surface of the image bearing member to a transfer material directly or via an intermediate transfer member; and a fixing device, including a fixing roller;

a heat roller including a first heat source and a second heat source, the first heat source including a first halogen heater configured to primarily irradiate a center portion of a paper feed area and the second heat source including a second halogen heater configured to primarily irradiate an end portion of the paper feed area;

a fixing belt stretched around the fixing roller and the heat roller;

a pressure roller comprising a pressure heat source including a third halogen heater and configured to rotate in press contact with the fixing roller;

a first temperature detector configured to detect a temperature of the center portion of the paper feed area on the fixing belt, which is used to control activation of the first heat source based on a first set temperature of the center portion;

a second temperature detector configured to detect a temperature of the end portion of the paper feed area on the fixing belt or a temperature of the fixing belt outside the paper feed area, which is used to control activation of the second heat source based on a second set temperature of the end portion; and a pressure temperature detector configured to detect a temperature of the paper feed area on the pressure roller, which is used to control activation of the pressure heat source based on a third set temperature of the paper feed area, wherein the halogen heaters are configured to be switched on and off at regular intervals according to a cycle to reduce power consumption, and at least one of the halogen heaters is controlled according to the cycle during paper feed;

a duty ratio of the first heat source is increased by an amount corresponding to a wattage used for the second heat source when the temperature detected by the second temperature detector is at or above the second set temperature during paper feed;

a duty ratio of the second heat source is increased by an amount corresponding to a wattage used for the first heat source when the temperature detected by the first temperature detector is at or above the first set temperature during paper feed; and a duty ratio of the pressure heat source is increased when the temperatures detected by the first temperature detector and the second temperature detector are at or above the first and second set temperatures, respectively, during paper feed.

10. An image forming apparatus, comprising:

an image bearing member on which a latent image is formed;

a charging device configured to uniformly charge a surface of the image bearing member;

an irradiation device configured to irradiate the charged surface of the image bearing member with light to write the latent image thereon;

a development device configured to visualize the latent image formed on the surface of the image bearing member with toner;

a transfer device configured to transfer the visualized toner image from the surface of the image bearing member to a transfer material directly or via an intermediate transfer member; and a fixing device, including a fixing roller;

a heat roller including a first heat source and a second heat source, the first heat source including a first halogen heater configured to primarily irradiate a center portion of a paper feed area and the second heat source including a second halogen heater configured to primarily irradiate an end portion of the paper feed area;

a fixing belt stretched around the fixing roller and the heat roller;

a pressure roller comprising a pressure heat source including a third halogen heater and configured to rotate in press contact with the fixing roller;

a first temperature detector configured to detect a temperature of the center portion of the paper feed area on the fixing belt, which is used to control activation of the first heat source based on a first set temperature of the center portion;

a second temperature detector configured to detect a temperature of the end portion of the paper feed area on the fixing belt or a temperature of the fixing belt outside the paper feed area, which is used to control activation of the second heat source based on a second set temperature of the end portion; and a pressure temperature detector configured to detect a temperature of the paper feed area on the pressure roller, which is used to control activation of the pressure heat source based on a third set temperature of the paper feed area, wherein the halogen heaters are configured to be switched on and off at regular intervals according to a cycle to reduce power consumption, and at least one of the halogen heaters is controlled according to the cycle during paper feed; and while the temperature detected by the first temperature detector is below the first set temperature during paper feed, the second heat source is activated at a first duty ratio when the temperature detected by the second temperature detector is below a predetermined temperature set below the second set temperature, and is activated at a second duty ratio, which is smaller than the first duty ratio, when the temperature detected by the second temperature detector is at or above the predetermined temperature and below the second set temperature.

* * * * *